US007603725B2

(12) United States Patent
Harris

(10) Patent No.: US 7,603,725 B2
(45) Date of Patent: Oct. 20, 2009

(54) SHOCK BALANCE CONTROLLER

(76) Inventor: Kerry Sheldon Harris, 1020 Yosemite Dr., Lemoore, CA (US) 93245

( * ) Notice: Subject to any disclaimer, the term of this patent is extended or adjusted under 35 U.S.C. 154(b) by 436 days.

(21) Appl. No.: 11/141,879

(22) Filed: May 31, 2005

(65) Prior Publication Data

US 2005/0268383 A1 Dec. 8, 2005

Related U.S. Application Data

(60) Provisional application No. 60/577,431, filed on Jun. 7, 2004.

(51) Int. Cl.
*A42B 3/00* (2006.01)

(52) U.S. Cl. ..... 2/413; 2/410

(58) Field of Classification Search ..... 2/410, 2/6.8, 411, 412, 413
See application file for complete search history.

(56) References Cited

U.S. PATENT DOCUMENTS 3,487,417 A * 12/1969 Morgan ..... 2/413
3,788,404 A * 1/1974 Koudelka et al. ..... 173/211
4,168,751 A * 9/1979 Deike ..... 173/1
4,716,826 A * 1/1988 Gibellino et al. ..... 101/169
5,390,367 A * 2/1995 Rush, III ..... 2/462
6,108,987 A * 8/2000 De La Fuente ..... 52/167.6
6,351,854 B1 * 3/2002 Whalen et al. ..... 2/413
6,381,759 B1 * 5/2002 Katz ..... 2/425
6,463,679 B1 * 10/2002 Buttigieg ..... 36/3 B
6,519,873 B1 * 2/2003 Buttigieg ..... 36/29
6,560,789 B2 * 5/2003 Whalen et al. ..... 2/455
6,817,039 B1 * 11/2004 Grilliot et al. ..... 2/413
6,889,451 B2 * 5/2005 Passke et al. ..... 36/29
2005/0268383 A1 * 12/2005 Harris ..... 2/413
2008/0155862 A1 * 7/2008 Battlogg et al. ..... 36/117.6

* cited by examiner

*Primary Examiner*—Shaun R Hurley
*Assistant Examiner*—Andrew W Sutton
(74) *Attorney, Agent, or Firm*—Gunn, Lee & Cave, PC; John C. Cave

(57) ABSTRACT

A shock balance controller is described, including a support structure configured to support the shock balance controller, the support structure having a chamber including a port disposed in a side of the chamber, the port providing an opening to a housing, and a bladder coupled to the housing, the bladder being filled with a first material configured to receive pressure from a shock, wherein the first material, when receiving the shock pushes a first piston that compresses a spring disposed in the housing, the spring pushing a second piston that increases the pressure of a second material stored in the chamber. A shock balance controller may also include a structure configured to support the shock balance controller, the structure having a chamber, a port, and a housing assembly, and a bladder coupled to the structure using the housing assembly, the bladder and housing assembly being configured to transfer energy between the bladder and the chamber.

12 Claims, 6 Drawing Sheets

SHOCK BALANCE CONTROLLER

CROSS REFERENCE TO RELATED APPLICATIONS

This application claims priority to U.S. Provisional Patent Application No. 60/577,431 entitled "Shock Balance Controller" filed Jun. 7, 2004 which is incorporated herein by reference for all purposes.

FIELD OF THE INVENTION

The present invention relates generally to safety equipment. Specifically, a shock balance controller is described.

BACKGROUND OF THE INVENTION

Shock absorption systems are used for a variety of purposes, particularly safety equipment, wear, and other devices that reduce bodily injury. Conventional techniques use materials such as molded plastics, foam, rubber, or other solid materials that absorb shock. For example, bicycle, motorcycle, and police/law enforcement/riot helmets use molded polystyrene with hardened outer plastic shells that, after being subjected to an impact of particular strength, must be replaced. The materials in the helmet reduce or eliminate trauma to the human skull and cranial regions by dissipating the force of a blow throughout the material, which often breaks apart as a result. As another example, cushioning materials in shoes (i.e., mid-sole cushioning) are often molded or formed within the overall structure and provided cushioning and support. However, conventional shock absorption systems are discarded when shoes are replaced. Conventional shock absorption systems are inefficient and expensive.

Conventional shock absorption systems are inefficient because they must be replaced after an impact occurs. The inner, protective polystyrene, rubber, or plastic lining of a crash helmet may be significantly damaged, regardless of whether an outer, hardened plastic shell is damaged by an impact. Structural damage to the inner lining eliminates the material strength and shock absorption capabilities of conventional systems. Further, conventional techniques do not evenly dissipate energy from an impact. The resulting localization of energy from an impact can cause localized trauma and damage in conventional systems. Still further, significant expense is incurred when a structure containing the conventional system must be replaced after an impact has occurred.

Thus, what is needed is a solution for absorbing and balancing impact energy without the limitations of conventional techniques.

BRIEF DESCRIPTION OF THE DRAWINGS

Various examples of the invention are disclosed in the following detailed description and the accompanying drawings.

DETAILED DESCRIPTION

Implementation of described techniques may occur in numerous ways, including as a system, device, apparatus, or process. A detailed description of one or more examples is provided below along with accompanying figures that illustrate the principles of the examples. The scope of the examples is limited only by the claims and encompasses numerous alternatives, modifications and equivalents. Numerous specific details are set forth in the following description. These details are provided solely for the purposes of example and may be practiced according to the claims without some or all of these specific details.

A shock balance controller is described. Various devices, components, systems, and processes may be implemented using the below-described techniques. In some examples, a shock balance controller may be implemented within various support structures such as helmets, shoes, or other protective wear. In other examples, a shock balance controller may be implemented in structures designed to absorb a shock, impact, blow, or pressure (hereafter "pressure"), such as crash helmets, protective clothing, shoes, and the like. The described examples may be varied and are not limited to the descriptions provided.

Figure 1:
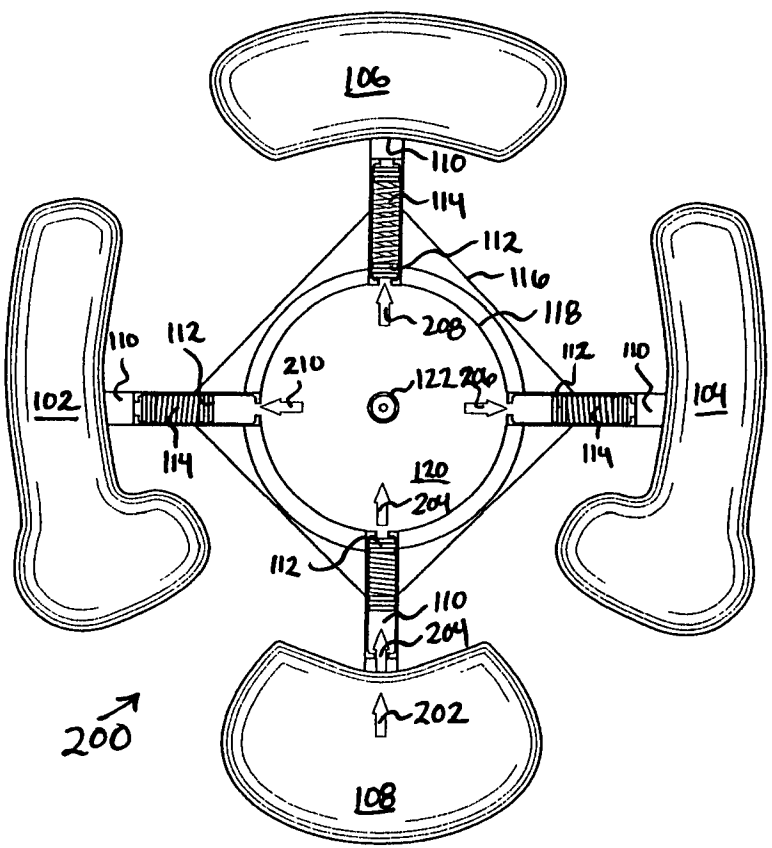
FIG. 1 illustrates an exemplary shock balance controller.

FIG. 1 illustrates an exemplary shock balance controller. Here, shock balance controller 100 includes bladders 102-108, pistons 110-112, springs 114, support structure 116, chamber side or wall (hereafter "chamber wall") 118, chamber 120, and fill valve 122. Shock balance controller 100 may be implemented such that bladders 102-108 are filled with a liquid or gas. In some examples, materials such as silicone oil may be used to fill bladders 102-108 and absorb energy from applied pressure. Chamber 120 may be filled with a gas (e.g., air, nitrogen, helium, and the like) using fill valve 122. Chamber 120 may be filled to different pressure levels using fill valve 122. In some examples, fill valve 122 may be used to increase or decrease pressure in chamber 120 relative to atmospheric conditions (e.g., altitude, barometric pressure, and the like). Gas in chamber 120 may displace pistons 112, which translate energy to or from springs 114. Pistons 112 and springs 114 may work in concert as an assembly or mechanism to transfer or cushion pressure balanced throughout shock balance controller 100. Likewise, energy may be translated from spring 114 to pistons 110, which operates on material (e.g., silicone oil) in bladders 102-108. In some examples, pistons 110-112 are disposed in housings or housing assemblies that include springs 114, which react to pressure displacements at bladders 102-108. Gaskets (not shown)

placed around the outer circumference of pistons 110-112 provide a seal to prevent gas filling chamber 120 or material (e.g., silicone oil) filling bladders 102-108 from leaking into each other. Support structure 116 supports the various components of system 100. System 100 may be implemented using different components, which may also be varied in size, shape, and numbers. For example, the number and dimensions of bladders may be varied and are not limited to those shown. System 100 and the above-described components may be varied in different implementations and are not limited to the examples shown.

Figure 2:
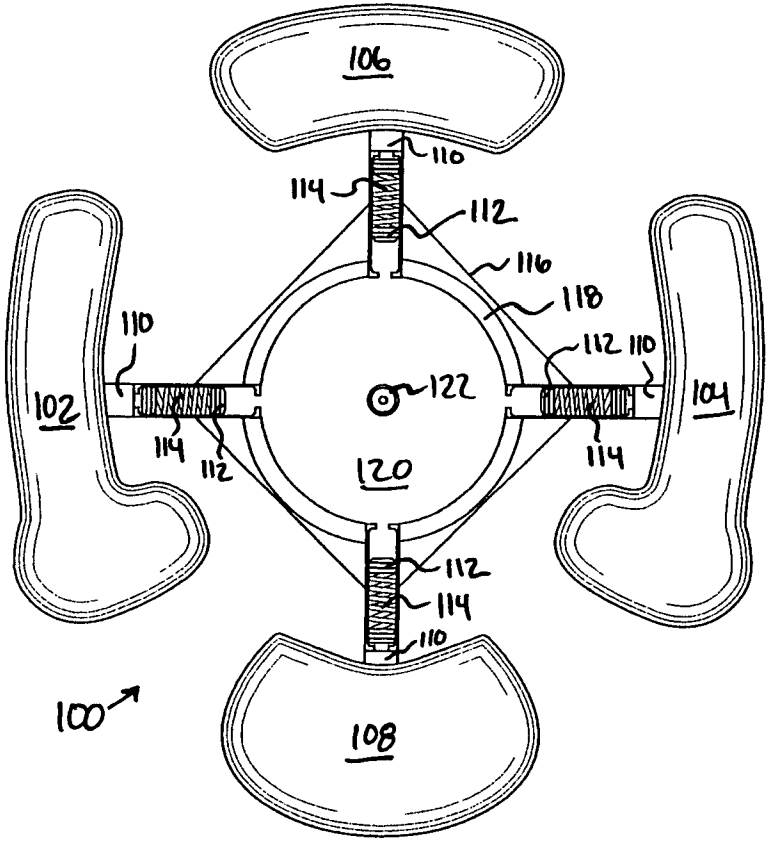
FIG. 2 is an alternative illustration of an exemplary shock balance controller.

FIG. 2 is an alternative illustration of an exemplary shock balance controller. Here, system 200 may be implemented using system 100 (FIG. 1). Arrows 202-210 indicate pressure action and reaction within system 200. When pressure is applied to one or more of bladders 102-108, the pressure in the material (e.g., silicone oil) is increased and translated from the affected bladder to gas (e.g., oxygen, nitrogen, helium, air, and the like) stored in chamber 120 via pistons 110-112 and springs 114. In some examples, pressure may also be transferred to unaffected bladders. Material in bladders 102-108 cushion an impact, receiving pressure that pushes pistons 110 and springs 114, which compress gas in chamber 120. As gas in chamber 120 is compressed, the pressure is dissipated and returned back to the impacted bladder, restoring system 100 to a state of equilibrium. Compressed springs 114 push pistons 112, which pushes the gas in chamber 120. When gas pressure in chamber 120 is increased in reaction to energy translated from springs 114, the compressed gas reacts to the affected piston and spring. As the compressed gas expands in chamber 120, pistons 112 and 114 are forced back towards the impacted bladder, increasing the pressure in the stored material within the impacted bladder. In some examples, an impact may be large and pressure may be translated from the compressed gas in chamber 120 to unaffected bladders. Pistons 112 and springs 114 act together to balance pressure in bladders 102-108, but gas stored in chamber 120 provides a "shock absorption" capability that allows bladders 102-108 to maintain a desired pressure level.

As an example, when pressure is applied to bladder 108, silicone oil in bladder 108 translates energy from the increased pressure to piston 110, as indicated by arrows 202 and 204. In turn, piston 110 compresses spring 114, which axially displaces or pushes piston 112 towards chamber 120. Gas pressure in chamber 120 increases as piston 112 is pushed. As piston 112 moves towards chamber 120, the gaseous volume is decreased, causing a subsequent increase in gas pressure. As gas pressure increases, energy from the impact dissipates and gas in chamber 120 expands and displaces pistons 110-112 and spring 114 back towards the impacted bladder. Impact forces applied at bladders 102-108 displace pistons 112 and compresses springs 114 in the housing assemblies. Chamber 120 and pressurized gas allow system 200 to maintain, absorb, and dissipate forces applied at bladders 102-108. In other examples, pressure applied to multiple bladders 102-108 may be handled as described above.

Figure 3:
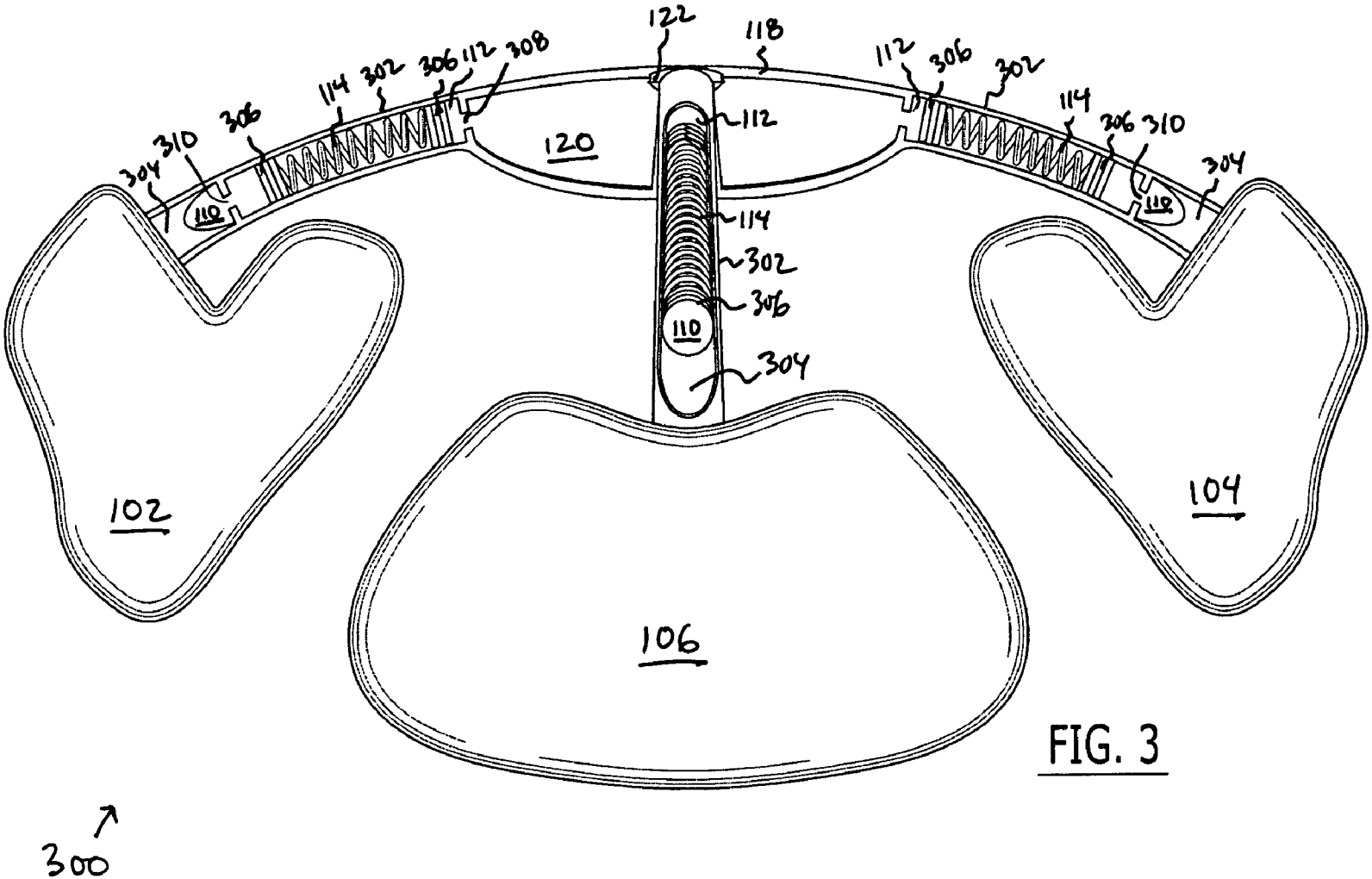
FIG. 3 illustrates a frontal view of an exemplary shock balance controller.

FIG. 3 illustrates a frontal view of an exemplary shock balance controller. Here, a more detailed illustration of system 300 is shown, including housings 302. Housings 302 include pistons 110-112 and springs 114. Pistons 110-112 may be implemented in various shapes and sizes. For example, pistons 110 in system 300 have rounded ends that enable compression of silicone oil without puncturing bladders 102-108. Housings 302 also include inner spaces 304, gaskets 306, and ports 308-310. Silicone oil (or another liquid or gaseous material) in bladders 102-108 are in fluid communication with pistons 110, which acts as a medium to compress springs 114. Gas in chamber 120 is the medium that pistons 112 act upon in order to absorb, transfer, dissipate, and balance pressure in system 300. Gaskets 306 disposed on the outer circumference of pistons 306 maintain a seal (i.e., hermetic) to prevent material in bladders 102-108 or gas in chamber 120 from leaking past pistons 110 and 112, respectively. When pistons 110 or 112 are forced into housing 302 due to increased pressures applied at either bladders 102-108 or chamber 120, spring 114 is compressed, which pushes a piston (e.g., 110 or 112) at the opposite end of spring 114 away from the area of increased pressure into an area of decreased pressure (e.g., chamber 120), causing the dissipation of pressure. In other examples, components of system 300 may be varied and are not limited to the examples shown.

Figure 4:
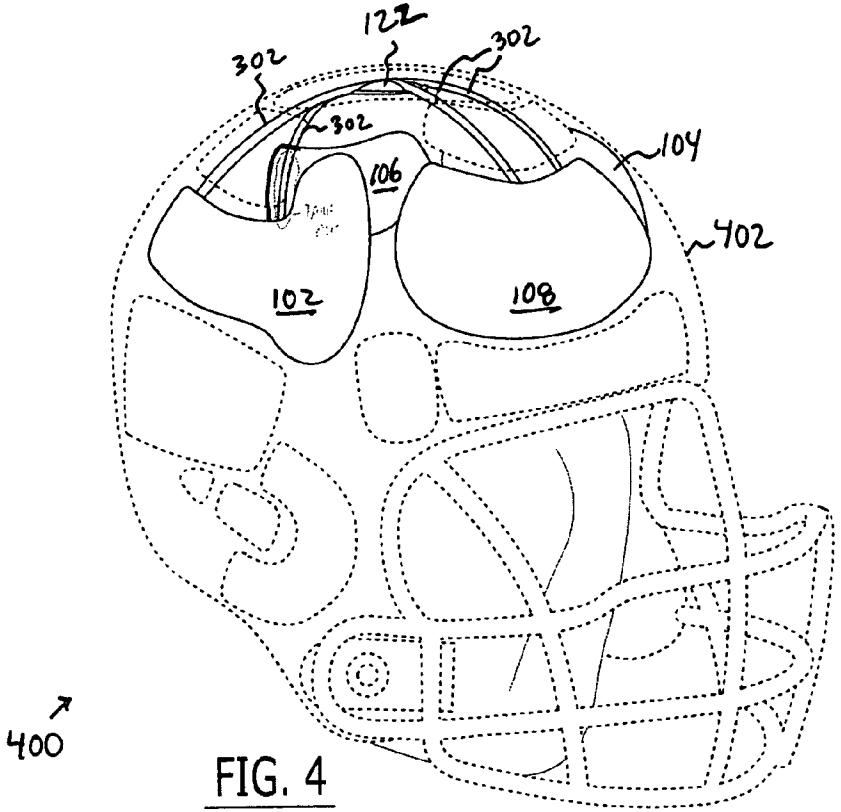
FIG. 4 illustrates an exemplary shock balance controller implemented in a helmet.

FIG. 4 illustrates an exemplary shock balance controller implemented in a helmet. In some examples, shock balance controller system 400 may be implemented in a crash helmet. Here, crash helmet 402 may be an athletic helmet that may include various padding, cushioning, or insulative materials. Placement of bladders 102-108 in crash helmet 402 are intended to provide protection to the upper cranial region of a human skull. If an impact occurs to a particular region of crash helmet 402, energy from the force of the impact may be dissipated by system 400. In other examples, shock balance controllers may be implemented in different types of head gear.

Figure 5:
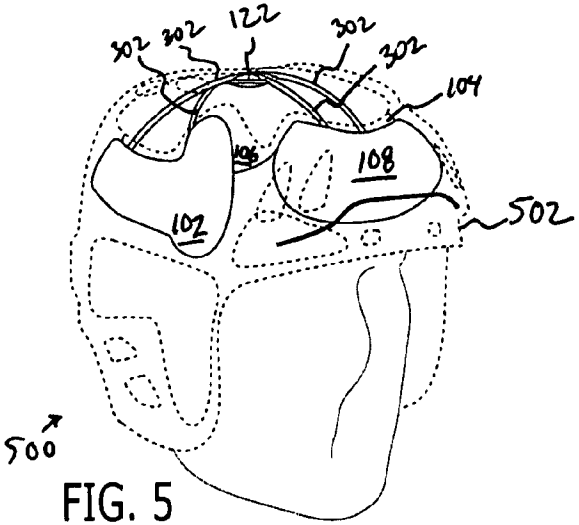
FIG. 5 is an alternative illustration of an exemplary shock balance controller implemented in a helmet.

FIG. 5 is an alternative illustration of an exemplary shock balance controller implemented in a helmet. As another example, shock balance controller system 500 (e.g., 100) may be implemented in crash helmet 502. As discussed above in connection with crash helmet 400 (FIG. 4), shock balance controller system 500 may be implemented to provide protection to a wearer from potential impacts that may be specific to particular uses (e.g., football vs. hockey).

Figure 6:
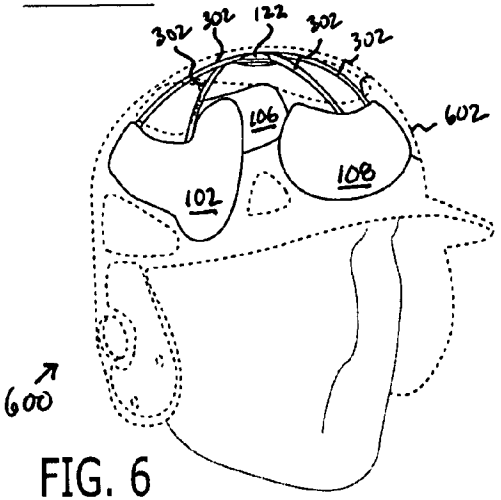
FIG. 6 is another alternative illustration of an exemplary shock balance controller implemented in a helmet.

FIG. 6 is another alternative illustration of an exemplary shock balance controller implemented in a helmet. Here, shock balance controller 600 may be implemented in athletic head gear. For example, crash helmet 602 may be used to house shock balance controller 600. In some examples, shock balance controller 600 may be implemented within a helmet liner of crash helmet 602. Shock balance controller 600 may be positioned so as to provide protection to a wearer while enabling other pads, liners, or cushioning material to be used for comfort and fitting purposes.

Figure 8:
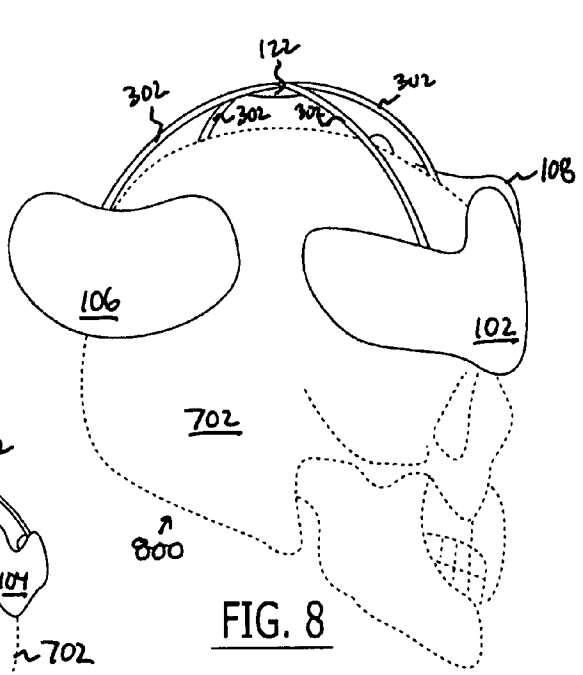
FIG. 8 is an alternative illustration of an exemplary shock balance controller positioned relative to a human skull.
Figure 9:
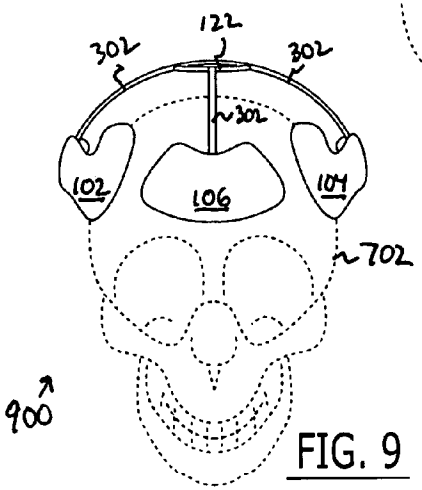
FIG. 9 is another alternative illustration of an exemplary shock balance controller positioned relative to a human skull.
Figure 7:
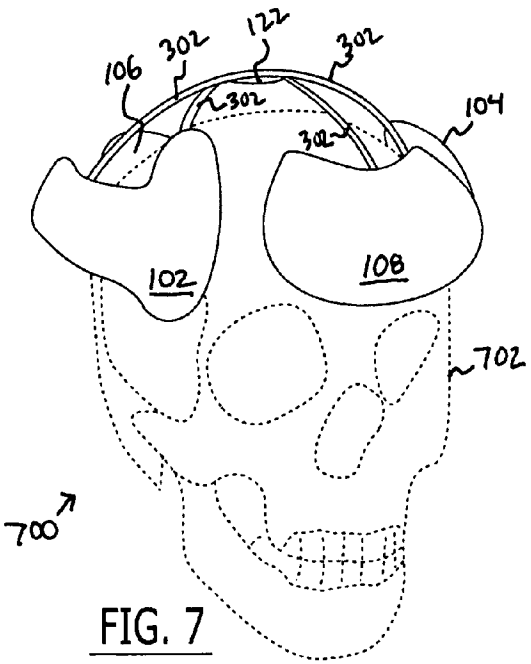
FIG. 7 illustrates an exemplary shock balance controller positioned relative to a human skull.

FIG. 7 illustrates an exemplary shock balance controller positioned relative to a human skull. Here, frontal view 700 is shown with a shock balance controller positioned relative to human skull 702. In some examples, bladder 102 is positioned over the right side of human skull 702. Bladder 108 may be positioned over the upper forehead region of human skull 702. Likewise, bladders 104 and 106 (as shown in FIG. 8) may be disposed over the left side and rear regions of human skull 702. FIG. 8 is an alternative illustration of an exemplary shock balance controller positioned relative to a human skull. Right rear side perspective 800 illustrates the positioning of a shock balance controller over human skull 702. The perspective illustrated in FIG. 8 shows the positioning of bladders 102, 106, and 108 as described above. Another alternative illustration is shown in FIG. 9. Here, upper frontal perspective 900 illustrates a shock balance controller system over human skull 702. In the above-described examples, housings 302 transfer pressure to unaffected bladders. Fill valve 122 may be used to replace, supplement, increase, or decrease air pressure in chamber 120 (FIG. 1), which is used to absorb impact or shock pressure from bladders 102-108.

Figures 10, 11, 12:
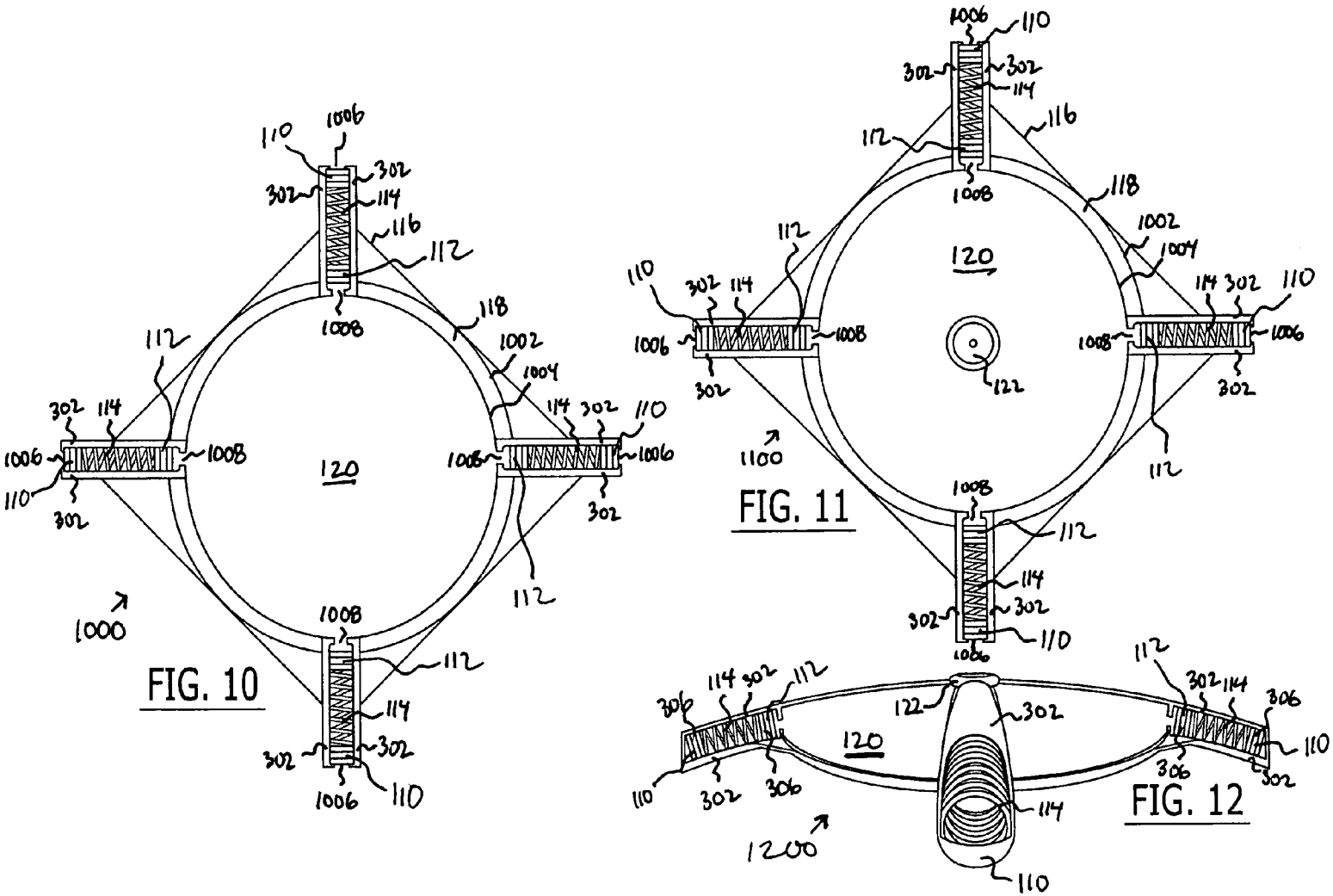
FIG. 10 illustrates an exemplary shock balance controller centerpiece.
FIG. 11 is an alternative illustration of an exemplary shock balance controller centerpiece.
FIG. 12 is another alternative illustration of an exemplary shock balance controller centerpiece.

FIG. 10 illustrates an exemplary shock balance controller centerpiece. In some examples, shock balance controller 1000 includes outer chamber wall 1002, inner chamber wall 1004, outer ports 1006, and inner ports 1008. Here, a vertical perspective of shock balance controller 1000 is shown. Gaseous pressure may be maintained within chamber 120 by chamber wall 118, outer chamber wall 1002, and inner chamber wall 1004. Gas within chamber 120 may be directed through ports 1008 to pistons 112, which compress springs 114. When compressed, springs 114 press pistons 110, which subsequently press and increase pressure on material (e.g., silicone oil) filling bladders 102-108. In the above-described examples, shock balance controller 1000 components (e.g., ports 1006, 1008, and others) may be varied. For example, other materials besides silicone oil may be used to fill bladders 102-108 (FIG. 1). Materials that are inert, non-toxic, lightweight, and others may be used. As another example, pistons 110-112 may be free-floating or attached to other components (e.g., springs 114). Other components and materials may be varied and are not limited to the examples described above.

FIG. 11 is an alternative illustration of an exemplary shock balance controller centerpiece. Here, an opposing vertical perspective (i.e., opposite to the perspective shown in FIG. 10) of shock balance controller 1100 is shown. In some examples, fill valve 122 may be disposed on the top, bottom, or a side of chamber 120. Fill valve 122 may be implemented as a one-way fill valve that allows chamber 120 to be pressurized (i.e., using an external pressure source (not shown)) to a desired level of pressure. Increasing or decreasing pressure in chamber 120 may be used to adjust the level of resistance that occurs when pressure is applied to bladders 102-108. In other words, the pressure of material (e.g., silicone oil) in bladders 102-108 may be adjusted to accommodate different potential impact pressures. FIG. 12 is another alternative illustration of an exemplary shock balance controller centerpiece. Here, a frontal perspective of shock balance controller 1200 is shown. Fill-valve 122 is disposed on top of shock balance controller 1200, which may be used to adjust gaseous pressure within chamber 120. In turn, pressure in chamber 120 may be used to absorb energy received from an impact and transferred via pistons 110-112 and spring 114. In other examples, shock balance controller 1200 may be implemented for different uses.

Figure 13:
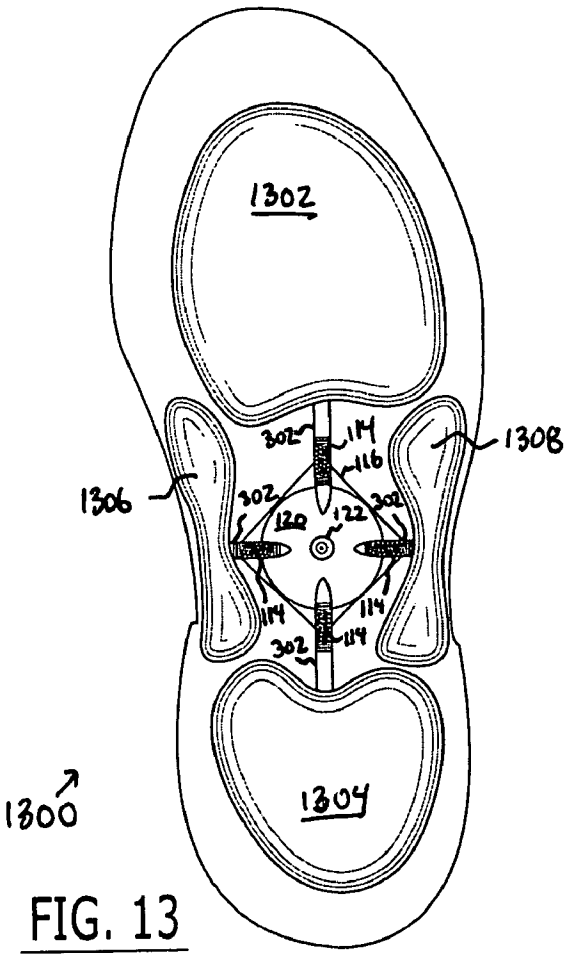
FIG. 13 illustrates an alternative example of an exemplary shock balance controller.

FIG. 13 illustrates an alternative example of an exemplary shock balance controller. Here, shock balance controller 1300 may be implemented in a shoe. In some examples, shock balance controller 1300 includes bladders 1302-1308. As discussed above, shock balance controller 1300 may also include springs 114, support structure 116, chamber 120, fill valve 122, and housings 302. Housing 302 may be used to transfer pressure via springs 114 between bladders 1302-1308. In some examples, support structure 116 may be used to support housings 302, chamber 120, and springs 114. Bladders 1302-1308 may be filled with materials similar to those described above, which provide shock absorption capabilities to the forefoot, heel, instep, and outer portions of a shoe. Impact pressures resulting from walking, running, or other motion-oriented activities may be absorbed by bladders 102-108. Other components of shock-balance controller 1300 may be varied in size, dimensions, materials, position, configuration, and are not limited to those described above.

Figure 14:
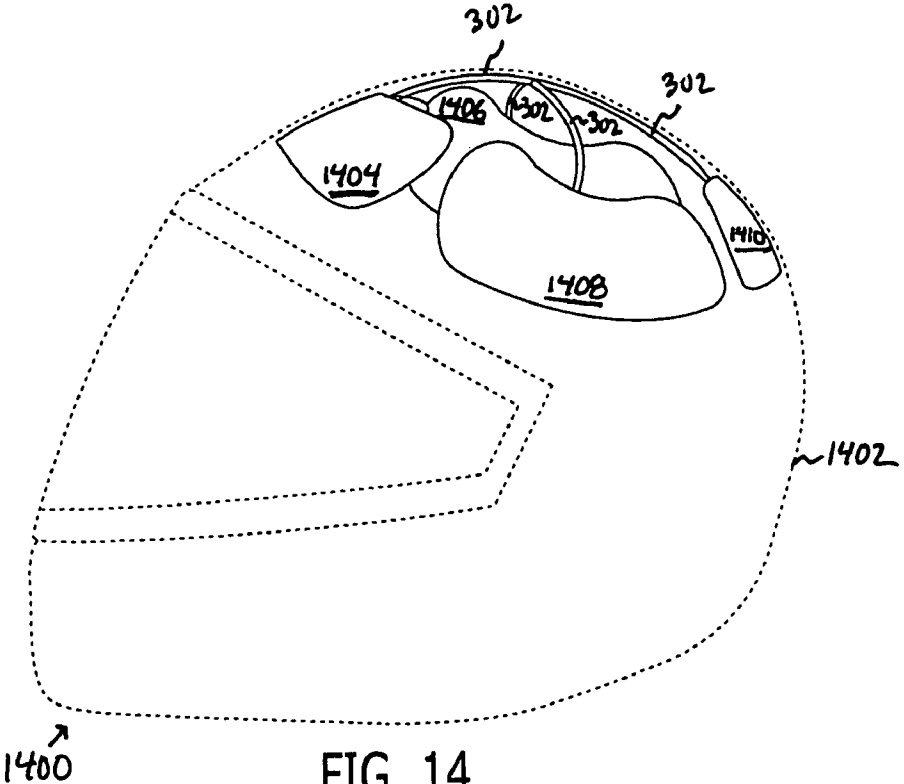
FIG. 14 illustrates another alternative example of an exemplary shock balance controller.

FIG. 14 illustrates another alternative example of an exemplary shock balance controller. Here, shock balance controller 1400 may be implemented in motorcycle crash helmet 1402. Shock balance controller 1400 includes bladders 1404-1410 and housings 302. In some examples, housings 302 may be used to translate energy from impacts at bladders 1404-1410 to chamber 120 (not shown). In other examples, a fill valve (e.g., 122 (FIG. 1)) may be used or not used. In the above examples, a fill valve may be used to vary pressure in a central chamber (e.g., chamber 120 (FIG. 1)). In other examples, a fill valve and central chamber may be omitted, enabling pressure to be directly transferred between bladders 1404-1410. In other examples, components of shock balance controller 1400 may be varied and are not limited to those described above.

Although the foregoing examples have been described in some detail for purposes of clarity of understanding, the invention is not limited to the details provided. There are many alternative ways of implementing the invention. The disclosed examples are illustrative and not restrictive.

What is claimed:

1. A shock balance controller, comprising:

a support structure comprising a chamber and a port disposed in a wall of the chamber;

a bladder being filled with a first material pressurized to a first pressure and a second material in the chamber being pressurized to a second pressure, wherein the first material is substantially different and not in fluid communication with the second material, wherein the support structure is configured to provide support to the bladder, the bladder being formed inside a crash helmet;

a housing coupling the bladder to the support structure, wherein the housing comprises a first piston having a gasket circumferentially disposed about an end of the first piston to provide a seal with the housing, and a second piston having another gasket circumferentially disposed about another end of the second piston to provide another seal with the housing; and a spring disposed in the housing between the first piston and the second piston, the spring being configured to transfer energy between the bladder and the support structure by moving the first piston to compress the spring, and the spring, when compressed, is configured to expand and move the second piston in the housing towards the chamber to increase the second pressure of the second material when the first pressure of the first material is increased upon receiving pressure from a shock.

2. The shock balance controller of claim 1, wherein the support structure includes a fill valve, the fill valve being configured to regulate the admission or release of gas from the chamber.

3. The shock balance controller of claim 1, wherein the chamber includes a plurality of ports opening into a plurality of housing.

4. The shock balance controller of claim 1, wherein the first material is a gas.

5. The shock balance controller of claim 1, wherein the first material is a liquid.

6. The shock balance controller of claim 1, wherein the second material is a gas.

7. The shock balance controller of claim 1, wherein the second material is a liquid.

8. The shock balance controller of claim 1, wherein the first material is silicone oil.

9. The shock balance controller of claim 1, wherein the first material is a non-toxic liquid.

10. The shock balance controller of claim 1, wherein the second material is a non-toxic liquid.

11. The shock balance controller of claim 1, wherein the first piston is coupled to a proximal end of the spring and the second piston is coupled to the distal end of the spring.

12. The shock balance controller of claim 11, wherein the first piston and the second piston are housed in a passage in the housing, the first piston and the second piston forming a seal with the passage.

* * * * *